United States Patent [19]

Vannatter

[11] 3,961,802

[45] June 8, 1976

[54] SKI BINDING

[76] Inventor: Harley E. Vannatter, 1432 Lakeshore Road, Sarnia, Ontario, Canada

[22] Filed: June 9, 1975

[21] Appl. No.: 584,884

[52] U.S. Cl. ..... 280/631
[51] Int. Cl.[2] ..... A63C 9/08
[58] Field of Search ..... 280/11.35 T

[56] References Cited

UNITED STATES PATENTS

| | | | |
|---|---|---|---|
| 3,241,849 | 3/1966 | Bodycomb | 280/11.35 T |
| 3,504,922 | 4/1970 | Wiley | 280/11.35 T |
| 3,612,559 | 10/1971 | Petersen | 280/11.35 T |
| 3,649,037 | 3/1972 | Vowthier | 280/11.35 T |

*Primary Examiner*—Robert R. Song

[57] ABSTRACT

A ski binding heel assembly for releasably securing the heel of a ski boot on a ski incorporates structure providing or "radial release" of the ski boot, i.e. release in response to displacement forces applied in a plane transverse to the length of the ski, irrespective of whether this displacement force is applied laterally or vertically, or in some intermediate direction. The ski binding includes a spring loaded latching element with a broad tapered tongue which is pressed into engagement with a socket in the heel of the ski boot. When a displacement force is applied to the heel of the ski boot, the complementary surfaces of the tongue and socket co-operate to cam the tongue back into the binding, thus releasing the ski boot.

9 Claims, 6 Drawing Figures

SKI BINDING

BACKGROUND OF THE INVENTION

This invention relates to a new or improved ski binding heel assembly for releasably securing the heel of a ski boot with respect to a ski.

DESCRIPTION OF THE PRIOR ART

At the present time, virtually all ski bindings sold for use in downhill skiing are of the release variety, i.e. are adapted to release the skier's boot from the ski in the event that an undue pressure is applied through to the ski binding, as for example, when the skier falls. The most widely used present-day ski bindings provide for lateral release of the toe assembly in response to a lateral pressure applied through the toe of the boot, and vertical release of the heel assembly in response to vertical pressure applied through the heel of the boot.

The object of the present invention is to provide a ski binding heel assembly for use in downhill skiing, which effectively holds the heel of the skier's boot to the ski for normal skiing, precluding inadvertent release, yet automatically releases the heel of the boot in any direction over a 180° radial arc transverse to the length of this ski, in conditions which could result in an injury to the skier, as in a fall.

SUMMARY OF THE INVENTION

Accordingly, the invention provides a ski binding heel assembly for releasably securing the heel of a ski boot on a ski, comprising: (a) mounting plate means for fixedly attaching the assembly to the top surface of a ski; (b) a housing carried on said mounting plate, and a latching element pivotally mounted in said housing and including a tapering tongue movable towards and away from a latching position wherein it projects forwardly from a front part of said housing, (c) spring means within said housing operative at one end to urge said latching element to pivot in a direction to move said tongue to the latching position; adjustment means in said housing engaging an opposite end of said spring means and selectively adjustable to vary the loading in said spring means and thereby adjust the force with which the tongue is urged towards the latching position; said tongue being transversely elongated and having an upwardly and forwardly inclined lower surface and symmetrically opposed lateral surfaces which converge in a forward direction, said tongue being adapted in the latching position to engage in a recess associated with the heel of a ski boot the recess having surfaces complementary to the lower and lateral surfaces respectively of the tongue, such that in use said spring means is normally effective to retain the latching element in the latching position and the heel of the ski boot on the ski through interengagement of said tongue with the recess, said latching element being pivotable against the force of said spring means to permit retraction of said tongue from the recess and release of the ski boot through interaction of said complementary tongue and recess surfaces in response to a displacement force of sufficient magnitude, as determined by the loading of the spring means, applied to the heel of the boot in any lateral or upward direction in a plane transverse to the length of the ski.

Preferably, the ski binding is designed to release in the lateral direction in response to a smaller displacement force than would be required to provide release in the vertical direction, and this is effected by varying the angles of inclination of the lower and lateral surfaces of the latching element tongue. For example, the lower surface may be inclined at 30° to horizontal, whereas the lateral surfaces may be inclined at 35° to the vertical. The depth of tongue penetration into the recess may also be different in the vertical release direction than in the horizontal release direction, the displacement force required to effect release varying accordingly.

The spring means preferably comprises a pair of coiled compression springs, totally enclosed within the housing of the assembly, and adjustable by means of a screw-threaded adjustment screw. Similarly, the tongue preferably projects through and substantially entirely fills an aperture at the front end of the housing, so that the mechanism of the ski binding assembly is substantially closed within the housing while substantially reducing the likelihood of malfunction caused by fouling of the mechanism by dirt, snow, ice, etc.

To improve the efficiency and reliability of the releasing action, The latching element tongue is fabricated from a brass forging which creates a low friction condition when in contact with the mating recess adapter mounted on the heel of the boot with said adapter being made of a high hardness stainless steel.

BRIEF DESCRIPTION OF THE DRAWINGS

The invention will further be described, by way of example only, with reference to the accompanying drawings in which.

DESCRIPTION OF THE PREFERRED EMBODIMENT

Figure 5:
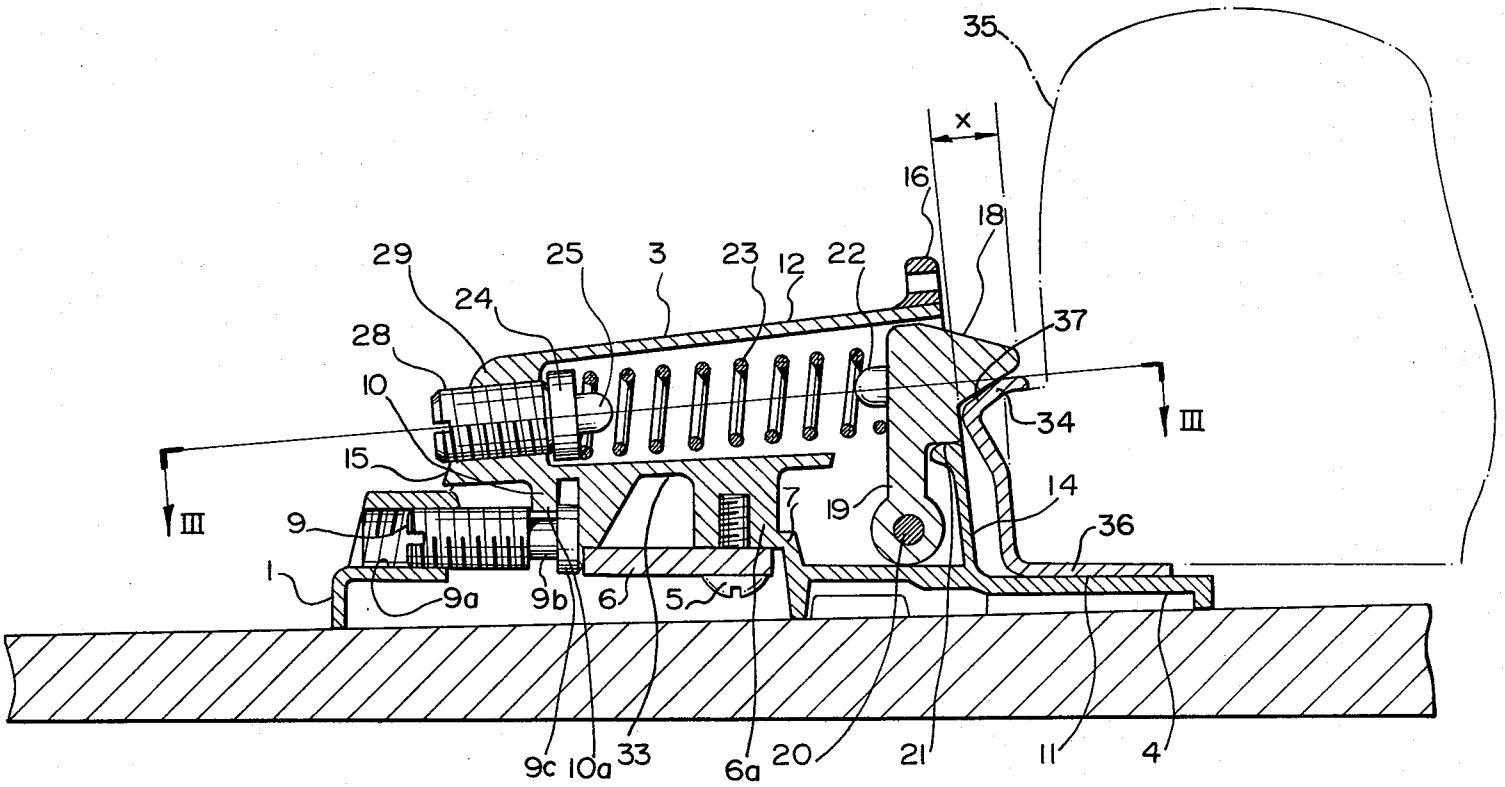
FIG. 5 is a longitudinal sectional view taken on the line V—V in FIG. 6, and showing the assembly as mounted on a ski in operative relation to a ski boot.

As shown in the drawings, the ski binding heel assembly comprises an elongated generally rectangular base plate 1 adapted to be mounted in fixed position to a ski as by the use of wood screws 2 (FIG. 5). To compensate for the conventional rearward tapering in thickness of the ski, the base plate 1 itself tapers in thickness from rear to front as will be evident in FIG. 1.

Figure 4:
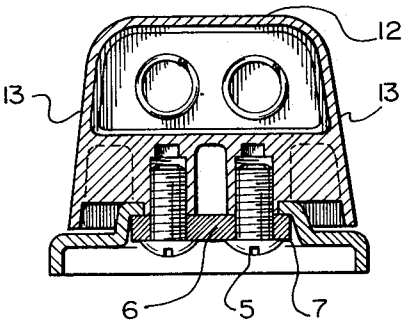
FIG. 4 is a sectional view taken on the line IV—IV in FIG. 1.
Figure 6:
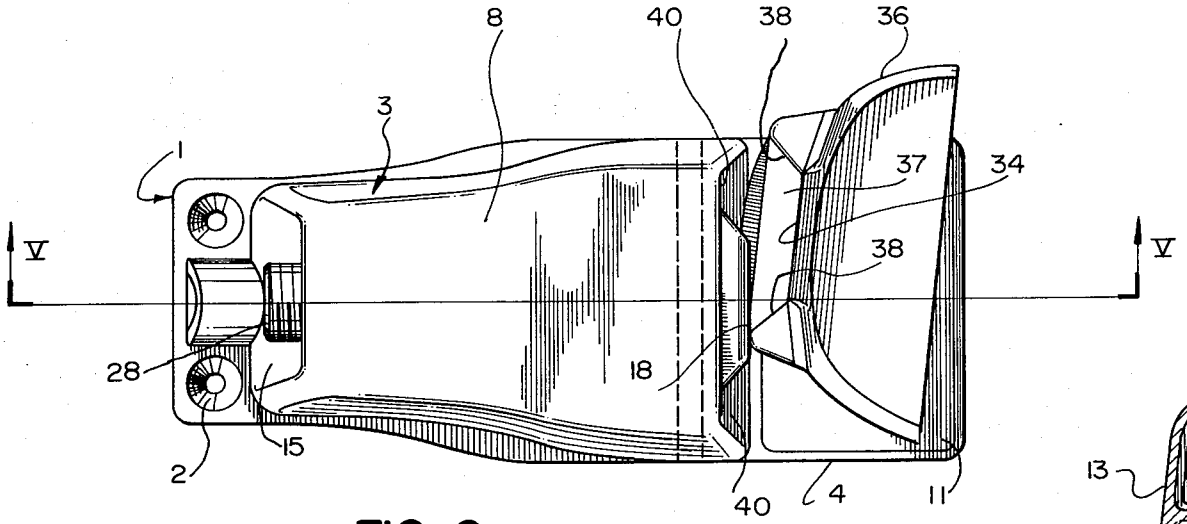
FIG. 6 is a plan view of the assembly illustrating its release function.

The rear part of the base plate is surmounted by a housing 3, the forward part of the base plate providing a platform 4 projecting forwardly of the housing. In conventional manner, the housing 3 is longitudinally adjustable with respect to the base plate, and is mounted on the base plate by two screws 5 and retainer bar 6 found on the underside of the base plate and hidden from view when mounted on the ski. The screws 5 screw the retainer bar 6 to a lug **6*a* on the underside of the housing 3, the bar 6 projecting laterally beyond the lug 6*a* on both sides (see FIG. 4) to define longitudinal ledges 7. The housing is guided on the base plate longitudinally and internally by the ledges 7 on the housing which lie beneath the edges of a rectangular window 8 on the base plate. A longitudinally extending threaded adjustment rod 9 is engaged in a threaded bore 9***a* in the rear of the housing and has a neck 9*b* of reduced diameter and a flat head 9*c* positioned against the rear of the lug 6*a*. The neck 9*b* is freely rotatable within a narrow slot 10*a* in a wall 10 of the housing 3. Adjustment of the housing is accomplished by rotation of the threaded adjustment rod 9 which, when turned clockwise or counterclockwise, pushes or pulls the housing to the desired setting through co-operation of the head 9*c* with the lug 6*a* and wall 10 of the housing.

The base plate 1 may be fabricated in any suitable material. Conveniently it is formed of a strong, lightweight material, as shown, as an aluminum die casting. A slip pad 11 of low friction material such as polytetrafluoroethylene is provided on the top surface of the platform 4 of the base plate.

Figure 1:
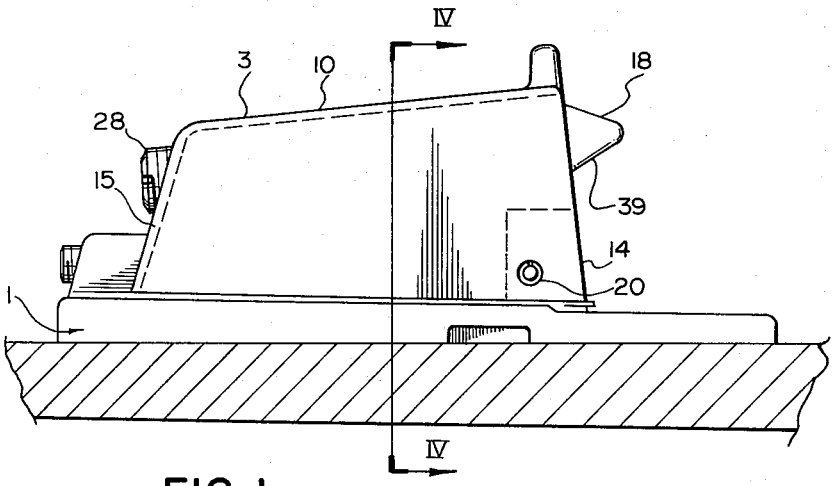
FIG. 1 is a side elevation of a ski binding heel assembly in accordance with the invention.
Figure 2:
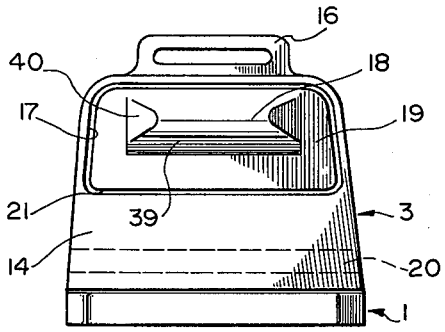
FIG. 2 is a front view thereof.

Similarly, the housing 3 is formed as an aluminum casting, and provides a substantially complete enclosure for the mechanism of the ski binding. Thus, the housing includes a top surface 12, opposed lateral surfaces 13, and transverse forward and rear surfaces 14 and 15 respectively. As is best seen in FIGS. 1 and 2, the forward surface 14 of the housing is of generally upright rectangular form, a portion extending above the top surface 12 of defining a loop or eye 16 for attachment of safety straps or the like by a skier. The forward surface 14 has in its upper portion a large rectangular aperture 17 through which the tongue 18 of a latching element 19 within the housing projects in a forward direction. The latching element 19 is carried on a pin 20 by means of which it is pivoted on a transverse axis in the forward lower portion of the housing 3. The latching element 19 is of substantially uniform width and extends vertically immediately behind the forward wall 14 of the housing, the tongue 18 being formed integrally with the upper end of the latching element. The latching element, and in particular the tongue 18 thereof, substantially entirely fills the aperture 17. Although for convenience in illustration, a substantial clearance is shown between the edges of the aperture 17 and the contiguous parts of the latching element, in practice, such clearance is kept to a minimum to reduce the possibility of foreign material entering the housing.

Figure 3:
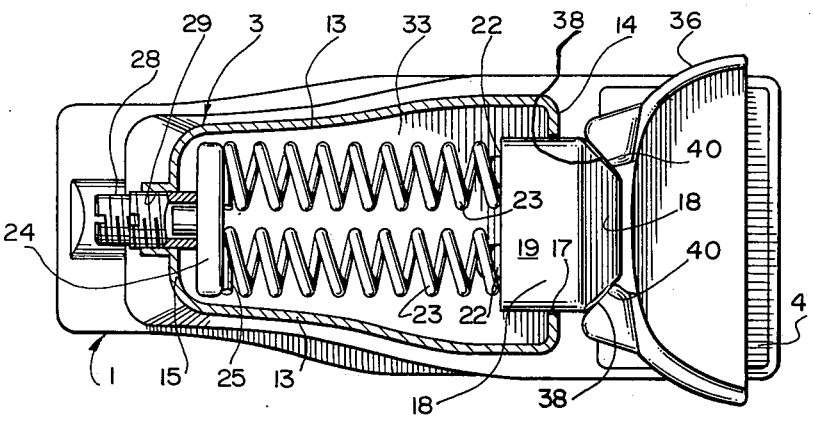
FIG. 3 is a sectional view taken along the line III-III in FIG. 5.

As will be evident, by virtue of the pitoval mounting of the latching element 19 on the pin 20, the tongue 18 can pivot about the transverse axis of the pin 20, and thus move in a generally longitudinal direction with respect to the aperture 17. Such movement is limited in the forward direction by abutment of the latching element 19 with the lower edge 21 of the aperture 17, as shown in FIG. 5, this abutment defining a latching position of the tongue 18. The tongue 18 is constantly urged into this latching position by a spring mechanism mounted within the housing 3. As is best seen in FIG. 3, at transversely spaced locations on the rear face of the latching element 19 are a pair of centering hubs 22 which serve to locate the forward ends of a pair of transversely spaced, longitudinally extending, coiled compression springs 23. The rear ends of the springs 23 press against an equalizer bar 24, being located thereon by a further pair of transversely spaced centering hubs 25. The rear face of the equalizer bar 24 is supported on the forward end of an adjuster screw 28 received in threaded engagement in a bore 29 in the rear of the housing 3, as best seen in FIG. 5. The adjuster screw 28 extends to the rear of the housing 3, and has a rear end which is slotted or otherwise formed for engagement by a tool. Rotation of the adjuster screw 28 is effective to move the equalizer bar 24 longitudinally, thereby varying in a selective manner the force with which the springs 23 press the latching element tongue 18 to the latching position.

Within the housing 3, a transverse horizontal wall extends forwardly from the rear between the lateral walls 13, terminating some distance to the rear of the latching element 19, and substantially isolating the springs 23 from the lower portion of the interior of the housing 3. This wall 33 serves to reduce the possibility of malfunction of the binding since it operates to isolate the springs 23 from any foreign matter such as dirt, ice or snow which may gain entry to the interior of the housing.

In operation, the binding is adapted to be mounted on a ski to retain the heel of a ski boot as shown in FIG. 5. It will be understood that a ski binding conventionally includes both a heel assembly and a toe assembly, but that no toe assembly is described or illustrated herein, since it forms no part of the present invention. The instant heel assembly may be used with any suitable toe assembly which is effective in operation to maintain the toe of a ski boot substantially immobile with respect to the ski. Preferably, however, the toe binding used will be such as to provide in combination with the heel assembly a "step-in" binding with a manual release feature whereby the skier may insert his boot in the binding, or remove it, at will.

As shown in FIG. 5, the tongue 18 of the heel assembly is shown in latching engagement with a recess 34 provided by a stainless steel heel adapter 36 attached, as shown, around the peripheral lower edge and bottom surface of the ski boot heel 35.

The recess 34 has smoothly curved edges, and defines inclined lower and lateral surfaces 37 and 38 which are complementary to the corresponding lower surface 39 and opposed lateral surface 40 of the tongue 18. The complementary engaging surfaces of the tongue 18 and the heel adapter 36 are provided in compatible low friction material. The latching element 19 is suitably formed in brass, or the various engaging surfaces may be coated with a low friction material such as polytetrafluoroethylene. The inclination of the operative surfaces of the tongue 18 (and similarly of the complementary surfaces of the heel adapter 36) is selected to suit the characteristics of the binding, particularly the strength of the springs 23, and may vary widely. However, to reduce the effects of frictional forces on the operation of the binding, it is preferred that these inclinations are not too small. For example, an inclination of the lower surface 39 of the tongue 18 to the horizontal of 30° (when in the latching position) has been found to give satisfactory results. For this value, a corresponding inclination of the lateral surfaces 40 of the tongue with respect to the longitudinal vertical plane would be about 35°, since it has been found desirable for the binding to be arranged such as to release in response to a lateral displacement force which is smaller than the force which would be required in the vertical release mode.

In operation, with the toe of the ski boot held in a suitable toe assembly, the springs 23 apply a retaining force (as determined by the setting of the adjusting screw 28) to press the tongue 18 of the latching element securely into engagement with the recess 34 in the rear of the ski boot. In this position, during normal skiing, the complementary surfaces 36 and 39 and 37 and 40 of the recess and tongue respectively serve to retain the heel of the ski boot immobile upon the slip pad 11 on the base of the assembly. When a displacement force is applied to the heel of the boot, as upon the skier suffering a fall, if the force is of sufficient magnitude to overcome the loading of the springs 23, the heel of the boot will commence to displace in the direction of the force, the corresponding surface of the recess 34 exerting a camming action on the complementary surface of the tongue 18 to cause the latter to move rearwardly about the pivot pin 20. As will be seen in FIG. 5, the forwardmost portion of the tongue 18 is at a distance (indicated by the letter X) forwardly of the rear edges of the surfaces defining the recess 34, and accordingly, the tongue 18 must be displaced rearwardly by the distance X before the binding will release. In other words, for a given setting of the binding, there is a "threshold" of displacement force which must be exceeded before the tongue 18 will move at all, and a higher "release" value for the displacement force which must be exceeded before the binding will fully release the ski boot. Displacement forces between the threshold and release values will occur quite commonly in normal skiing, and the incremental movement of the tongue 18 caused by these forces will have a beneficial value in reducing any tendancy towards freezing of the mechanism should snow or water gain access to the interior of the housing. Naturally, forces in this intermediate range will at the same time produce minor displacements of the heel of the ski boot, but the complementary shape of the tongue 18 and the recess 34 combine to re-position or center the heel of the boot once the force disappears, so that such minor displacements are purely transient in nature.

When a displacement force in excess of the release value is applied, the tongue 18 will be moved smoothly back thus allowing rapid disengagement of the ski boot from the heel assembly. Where the displacement force is in a purely vertical direction, retraction of the tongue is effected through the co-operation of the surfaces 37 and 39. When the displacement force is in a purely lateral direction, retraction will be caused through co-operation of the lateral surfaces 38 and 40 on the appropriate side. Where the displacement force is in a direction intermediate the vertical and lateral, the tongue will be retracted through the combined engagement of the lower surfaces 37 and 39, and one or other of the pairs of lateral surfaces 38 and 40.

The provision of the slip pad 11 beneath the heel of the ski boot in co-operation with the lower part of the heel adapter 36, facilitates lateral release of the ski boot whether in weighted or unweighted condition, and helps to ensure that the binding will release consistently at the desired setting.

What I claim as my invention is:

1. A ski binding heel assembly for releasably securing the heel of a ski boot on a ski, comprising:

a. mounting plate means for fixedly attaching the assembly to the top surface of a ski;

b. a housing carried on said mounting plate, and a latching element pivotally mounted in said housing and including a tapering tongue movable towards and away from a latching position wherein it projects forwardly from a front part of said housing;

c. spring means within said housing operative at one end to urge said latching element to pivot in a direction to move said tongue to the latching position; and d. adjustment means in said housing engaging an opposite end of said spring means and selectively adjustable to vary the loading in said spring means and thereby adjust the force with which the tongue is urged towards the latching position; said tongue being transversely elongated and having an upwardly and forwardly inclined lower surface and symmetrically opposed lateral surfaces which converge in a forward direction, said tongue being adapted in the latching position to engage in a recess associated with the heel of a ski boot the recess having surfaces complementary to the lower and lateral surfaces respectively of the tongue;

such that in use said spring means is normally effective to retain the latching element in the latching position and the heel of the ski boot on the ski through interengagement of said tongue with the recess, said latching element beng pivotable against the force of said spring means to permit retraction of said tongue from the recess and release of the ski boot through interaction of said complementary tongue and recess surfaces in response to a displacement force of sufficient magnitude, as determined by the loading of the spring means, applied to the heel of the boot in any lateral or upward direction in a plane transverse to the length of the ski.

2. A ski binding heel assembly according to claim 1 wherein the angle of inclination of the lower surface of the latching element tongue of the horizontal plane is less than the angle of inclination of the lateral surfaces thereof to a longitudinal vertical plane, such that for a given loading in said spring means, the magnitude of the displacement force required to cause retraction of said tongue is less when said force is applied in a lateral direction than when applied in a upwards direction.

3. A ski binding heel assembly according to claim 2 wherein said angles of inclination are approximately 30° and 35° respectively.

4. A ski binding heel assembly according to claim 2 wherein said spring means is substantially totally enclosed within said housing.

5. A ski binding heel assembly according to claim 4 wherein said spring means comprises a pair of laterally-spaced, longitudinally extending coiled compression springs having forward ends which press against locating means on said latching element, and rear ends which press against locating means on one side of a transverse equalizing bar, said adjustment means engaging an opposite side of said equalizing bar.

6. A ski binding heel assembly according to claim 5 wherein said adjustment means comprises a longitudinally arranged screw threadably received in a bore in said housing and having a forward end adapted to co-operate with said equalizer bar and a rear end adapted to be engaged for rotation by a tool.

7. A ski binding heel assembly according to claim 5 wherein said latching element is mounted to pivot on a transverse axis in the lower forward portion of the housing and extends generally upwardly therefrom the tongue projecting forwardly through, and in the latching position substantially closing, an aperture in a front wall of said housing.

8. A ski binding heel assembly according to claim 2 wherein at least the lower and lateral surfaces of the tongue of the latching element are of low friction material.

9. A ski binding heel assembly according to claim 8 wherein said mounting plate includes a platform extending forwardly of said housing, said platform including a pad of low friction material to support the bottom surface of the heel of the ski boot.

* * * * *